US005558972A

United States Patent [19]

Van Damme et al.

[11] Patent Number: 5,558,972

[45] Date of Patent: Sep. 24, 1996

[54] THERMAL TRANSFER PRINTING OF A REDUCING AGENT TO A SILVER SOURCE CONTAINED IN AN IMAGE RECEIVING LAYER

[75] Inventors: Marc Van Damme, Heverlee; Herman Uytterhoeven, Bonheiden; Geert Defieuw, Kessel-Lo, all of Belgium

[73] Assignee: Agfa-Gevaert, Mortsel, Belgium

[21] Appl. No.: 450,632

[22] Filed: May 25, 1995

[30] Foreign Application Priority Data

Jun. 27, 1994 [EP] European Pat. Off. ..... 94201827

[51] Int. Cl.[6] ..... G03C 8/00

[52] U.S. Cl. ..... 430/200; 430/203; 430/256; 430/617

[58] Field of Search ..... 430/3, 22, 617, 430/200, 201, 256, 348, 964, 203

[56] References Cited

U.S. PATENT DOCUMENTS 3,218,166 11/1965 Reitter .
3,767,414 10/1973 Huffman et al. .
3,795,532 3/1974 Newman et al. .
5,374,514 12/1994 Kirk et al. ..... 430/619
5,380,607 1/1995 Van Haute et al. ..... 430/3
5,384,238 1/1995 Ellis et al. ..... 430/617

*Primary Examiner*—Thorl Chea
*Attorney, Agent, or Firm*—Brumbaugh, Graves, Donohue & Raymond

[57] ABSTRACT

The present invention discloses a thermal imaging process using (i) a donor element comprising on a support a donor layer containing a binder and a thermotransferable reducing agent capable of reducing a silver source to metallic silver upon heating and (ii) a receiving element comprising on a support in the order given a receiving layer and a curable layer, said receiving layer comprising a silver source capable of being reduced by means of heat in the presence of a reducing agent for said silver source and a binder, said thermal imaging process comprising the steps of bringing said donor layer of said donor element into face to face relationship with said receiving layer of said receiving element, image-wise heating a thus obtained assemblage, thereby causing image-wise transfer of an amount of said thermotransferable reducing agent to said receiving element in accordance with the amount of heat supplied, separating said donor element from said receiving element, curing said release layer and overall heating said receiving element.

7 Claims, No Drawings

THERMAL TRANSFER PRINTING OF A REDUCING AGENT TO A SILVER SOURCE CONTAINED IN AN IMAGE RECEIVING LAYER

DESCRIPTION

1. Field of the Invention

The present invention relates to a thermal imaging process, more particular to a method wherein a thermotransferable reducing agent of a donor element is transferred image-wise to a receiving element, comprising in the order given a receiving layer comprising a reducible silver source and a curable layer.

2. Background of the Invention

Thermal imaging or thermography is a recording process wherein images are generated by the use of imagewise modulated thermal energy.

In thermography two approaches are known:

1. Direct thermal formation of a visible image pattern by imagewise heating of a recording material containing matter that by chemical or physical process changes colour or optical density.

2. Formation of a visible image pattern by transfer of a coloured species from an imagewise heated donor element onto a receptor element.

A survey of "direct thermal" imaging methods is given in the book "Imaging Systems" by Kurt I. Jacobson-Ralph E. Jacobson, The Focal Press—London and New York (1976), Chapter VII under the heading "7.1 Thermography". Thermography is concerned with materials which are not photosensitive, but are heat sensitive. Imagewise applied heat is sufficient to bring about a visible change in a thermosensitive imaging material.

According to a direct thermal embodiment operating by physical change, a recording material is used which contains a coloured support or support coated with a coloured layer which itself is overcoated with an opaque white light reflecting layer that can fuse to a clear, transparent state whereby the coloured support is no longer masked. Physical thermographic systems operating with such kind of recording material are described on pages 136 and 137 of the above mentioned book of Kurt I. Jacobson et al.

The thermal imaging process described in European Patent Application nr. 94200612 and in European Patent Application nr. 94201382.2 uses (i) a donor element comprising on a support a donor layer containing a binder and a thermotransferable reducing agent capable of reducing a silver source to metallic silver upon heating and (ii) a receiving element comprising on a support a receiving layer comprising a silver source capable of being reduced by means of heat in the presence of a reducing agent, said thermal imaging process comprising the steps of bringing said donor layer of said donor element into face to face relationship with said receiving layer of said receiving element, image-wise heating a thus obtained assemblage by means of a thermal head or a laser, thereby causing image-wise transfer of an amount of said thermotransferable reducing agent to said receiving element in accordance with the amount of heat supplied by said thermal head and separating said donor element from said receiving element.

It is known that the print density of the images obtained by this printing method can be increased by an overall heating of the receiving element after transfer, such as mentioned in European Patent Application No. 94200612. However, low molecular weight substances evaporate from the print during this heating procedure, giving rise to severe odour problems. This is especially observed when the heating is performed from the back side of the support.

3. Object of the Present Invention

It is an object of the present invention to provide a thermal imaging process wherein images are obtained with high optical densities, without generating substantial odour during the post-heating step.

Further objects will become apparent from the description hereinafter.

According to the present invention, there is provided a thermal imaging process using (i) a donor element comprising on a support a donor layer containing a binder and a thermotransferable reducing agent capable of reducing a silver source to metallic silver and (ii) a receiving element comprising on a support in the order given a receiving layer and a curable layer, said receiving layer comprising a binder and a silver source capable of being reduced by means of heat in the presence of a reducing agent for said silver source, said thermal imaging process comprising the steps of bringing said donor layer of said donor element into face to face relationship with said receiving layer of said receiving element, image-wise heating a thus obtained assemblage thereby causing image-wise transfer of an amount of said thermotransferable reducing agent to said receiving element in accordance with the amount of heat supplied separating said donor element from said receiving element curing said curable layer and overall heating said receiving element.

Image-wise heating in accordance with the present invention is preferably performed by means of a laser or a thermal head.

DETAILED DESCRIPTION OF THE INVENTION

The receiving element for use according to the printing method of the present invention comprises on a support in the order given, a receiving layer and a curable layer.

The receiving layer comprises a binder and a reducible silver source.

The reducible silver source may comprise any material that contains a reducible source of silver ions. Silver salts of organic and hetero-organic acids, particularly long chain fatty carboxylic acids (comprising from 10 to 30, preferably 15 to 25 carbon atoms) are preferred. Complexes of organic or inorganic silver salts in which the ligand has a gross stability constant for silver ion of between 4.0 and 10.0 are also useful. Examples of suitable silver salts are disclosed in Research Disclosure Nos. 17029 and 29963 and include: salts of organic acids, e.g., gallic acid, oxalic acid, behenic acid, stoatic acid, palmitic acid, lauric acid and the like; silver carboxyalkylthiourea salts, e.g., 1-(3-carboxypropyl)thiourea, 1-(3-carboxypropyl)-3,3-dimethylthiourea and the like; complexes of silver with the polymeric reaction product of an aldehyde with a hydroxy-substituted aromatic carboxylic acid, e.g., aldehydes, such as formaldehyde, acetaldehyde and butyraldehyde, and hydroxy-substituted acids, such as salicyclic acid, benzilic acid, 3,5-dihdyroxybenziic acid and 5,5-thiodisalicylic acid; silver salts or complexes of thiones, e.g., 3-(2-carboxyethyl) -4-hydroxymethyl-4-thiazoline-2-thione and 3-carboxymethyl-4-methyl-4-thiazoline-2-thione; complexes of salts of silver with nitrogen acids selected from imidazole, pyrazole, urazole, 1,2,4-triazole and 1H-tetrazole, 3-amino-5-benzylthio-1,2,4-triazole and benzotriazole; silver salts of saccharin, 5-chlorosalicylaldoxime and the like; and silver salts of mercaptides.

The preferred silver source is silver behenate.

The silver source is preferably added as a dispersion to the coating liquid of the receiving layer.

As binding agent for the receiving layer preferably thermoplastic water insoluble resins are used wherein the ingredients can be dispersed homogeneously or form therewith a solid-state solution. For that purpose all kinds of natural, modified natural or synthetic resins may be used, e.g. cellulose derivatives such as ethylcellulose, cellulose esters, carboxymethylcellulose, starch ethers, polymers derived from α,β-ethylenically unsaturated compounds such as polyvinyl chloride, after chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals, e.g. polyvinyl butyral, copolymers of acrylonitrile and acrylamide, polyacrylic acid esters, polymethacrylic acid esters and polyethylene or mixtures thereof. A particularly suitable ecologically interesting (halogen-free) binder is polyvinyl butyral. A polyvinyl butyral containing some vinyl alcohol units is marketed under the trade name BUTVAR™B79 of Monsanto USA. Another interesting binder is cellulose acetate butyrate.

Odour problems are especially observed when polyvinylbutyral is used as a binder for the receiving layer. This binder is, however, preferred because dispersions of silver behenate in polyvinylbutyral are stable and yield a small particle size. This is required to obtain a transparant receiving element.

The binder to organic silver salt weight ratio is preferably in the range of 0.2 to 6, and the thickness of the receiving layer is preferably in the range of 5 to 16 μm.

It is preferred to use a so-called toning agent in the receiving layer or in a layer adjacent to said receiving layer. This toning agent serves to change the tone of the silver image from brown to black or grey. Suitable toning agents are e.g. phthatazinone, phthalazine, phthalimide, succinimide, phthalic acid, benzimidazole or compound (I)

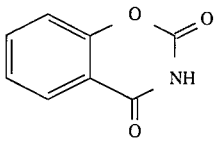

(I)

The use of phthalazinone or compound (I) or a mixture thereof is highly preferred.

It is preferred to use a weak reducing agent in the receiving layer of the receiving element. This weak reducing agent is only capable of reducing said silver source by means of heat in the presence of metallic silver. This metallic silver is generated by the reducing agent from the donor element (after image-wise transfer).

Suitable weak reducing agents can be found in the class of so called rubber or polymer antioxidantia e.g. sterically hindered substituted 2,2'- or 4,4'-methylenebisphenol compounds.

Preferred weak reducing agents are selected from the group of sterically hindered phenols and sterically hindered bisphenols.

Useful weak reducing agents are e.g.

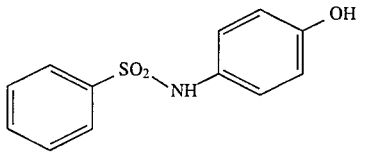

(II)

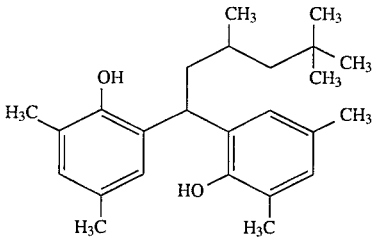

(III)

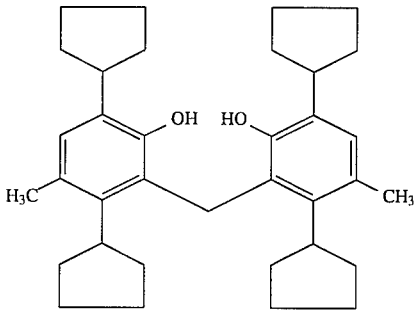

(IV)

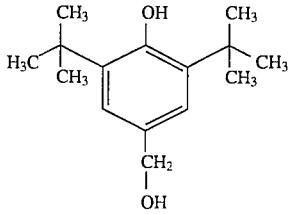

(V)

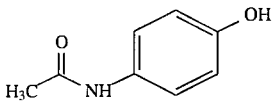

(VI)

Compounds (IV) and (III) are especially preferred. A mixture of weak reducing agents in the image receiving layer is particularly advantageous with regard to avoiding crystallisation during storage.

The curable layer of the present invention is hardenable, i.e. one or more components of the curable layer can be crosslinked by means of e.g. heat curing, electron beam curing or UV curing. The curable layer preferably functions as a release layer i.e. has release properties towards the donor layer of the donor element. During image-wise heating, the donor layer of the donor element is in close contact with the surface of the receiving element.

For this purpose the curable layer may comprise a release agent.

As release agents, inorganic and organic release agents can be used. Among them, the organic release agent, are preferred.

Solid waxes, fluorine- or phosphate-containing surfactants and silicone oils can be used as releasing agent. Suitable releasing agents have been described in e.g. EP 133012, JP 85/19138, and EP 227092.

The release agents, instead of being provided in the curable layer, may also be provided cn top of the curable layer. In case there is a sufficient release between the donor and receiving element, the release agents may be omitted.

The release agents when used in the curable layer may be curable or can be mixed with a curable binder. Chemically curable binders usually incorporate functional groups, such as alcohols, acids, amines and the like. Examples cf such binders are polyvinylalcohol, polyacrylic acid, poly (vinylchloride-co-vinylacetate-co-vinylalcohol) and the like.

Hydrophobic binders (not soluble in water) are preferred, while they permit fast transfer of the reducing agents from the donor element to the receiving layer of the receiving element during image-wise heating.

Although chemical curing is oossible in the printing process of the present invention, UV-curing is more preferred. UV-curing can be performed by using UV-curable release agents and/or UV-curable binders and/or other UV-curable additives.

A survey of UV/-curabte coating compositions is given e.g. in the periodical "Coating" 9/88, p. 348–353. In that connection further reference is made to the book "Chemistry & Technology of UV and EB formulation for coatings, inks & paints—Volume 2: "Prepolymers and reactive diluents for UV and EB curable formulations" by N. S. Allen, M. A. Johnson, P. K. T. Oldring, M. S. Salim, published by SITA Technology Lts. London (ISBN 0 947798 10 2).

Examples of UV-curable release agents are silicone (meth)acrylates sold under the tradenames EBECRYL™ 350, EBECRYL™ 1360, Si-Dehäsiv™ VP 1530 (UV-curable) and Si-Dehäsiv™ VP 1959 (EB-curable) from WACKER—Germany, TEGO™ silicone acrylates 704, 705, 706, 707, 725 and 726 which are difunctional UV and EB curable reactive slipping agents.

Examples of UV-curable binders are modified cellulose polymers containing acrylamidomethyl groups, commercially available from BOMAR Specialities Company under the tradename JAYLINK™. Unsaturated polyesters can also be used as UV-curable binders. Typical unsaturated polyesters are based on a mixture of glycols and di-acids including an unsaturated acid such as maleic anhydride, fumaric acid or itaconic acid.

Examples of UV-curable additives are multifunctional monomers and prepolymers. Examples of suitable prepolymers for use in an UV-curable composition applied according to the present invention are the following: polyester (meth) acrylates; urethane-polyester (meth) acrylates; expoxy (meth) acrylates; potyether (meth) acrylates and urethane (meth) acrylates.

Examples of free radical polymerizable liquid monomers that preferably serve as solvent or diluent for the prepolymers and therefore are called diluent mcnomers are the following: methyl (meth)acrylate, ethyl acrylate, butyl acrylate, 2-ethylhexyl methacrylate, 2-hydroxyethyl acrylate, 2-hydroxyethyl methacrylate, glycidyl methacrylate, n-hexyl acrylate, lauryl acrylate, tetrahydrofurfuryl-methacrylate and an aromatic epoxyacrylate.

Examples of suitable di-functional monomers are: 1,6-hexanediol diacrylate, 1,6-hexanediol dimethacrylate, silicone diacrylate, neopentylglycol, 1,4-butanediol diacrylate, ethyleneglycol diacrylate, polyethyleneglycol diacrylate, pentaerythritol diacrylate, divinylbenzene.

Examples of suitable tri- or more-functional monomers are: trimethylolprepane triacrylate, trimethylolpropane trimethacrylate, pentaerythritol triacrylate, dipentaerythritol hexacrylate, and acrylate of ethylenediamine, aliphatic and aromatic urethane acrylates.

When the radiation-curing is carried out with ultraviolet radiation (UV), a photoinitiator is preferably present in the coating composition to serve as a catalyst to initiate crosslinking resulting in curing of the curable layer composition. A survey of photoinitiators is given in Table 10.3 of the already mentioned book "Imaging Systems" of Kurt I. Jacobson and Ralph E. Jacobson, and in the already mentioned book "Chemistry & Technology of UV & EB formulation for coatings, inks & paints" Volume 3: Photoinitiators for free radical and cationic polymerisation, by K. K. Dietliker, published by SITA Technology Ltd. London (ISBN 0 947798 10 2).

Photoinitiators suitable for use in UV-curable coating compositions belong to the class of organic carbonyl compounds, for example, benzoin ether series compounds such as benzoin isopropyl, isobutylether; benzil ketal series compounds, ketoxime esters; benzophenone series compounds such as benzophenene, o-benzoylmethylbenzoate; acetophenone series compounds such as acetophencne, trichloroacetophenone, 1,1-dichloroacetophenone, dialkoxyacetophenone, hydroxyalkylphenone, aminoalkylphenone, acylphosphine oxide, 2,2-diethoxyacetophenene, 2,2-dimethoxy-2phenytacetophenone; thioxanthene series compounds such as 2-chlorothioxanthone, 2-ethylthioxanthone; and compounds such as 2-hydroxy-2-methylpropiophenone, 2-hydroxy-4'-isopropyl-2-methylropiophenone, 1-hydroxycyclohexylphenylketone and 1,2-diketone derivatives. Benzephenone, thicxanthone and 1,2-diketone derivatives are preferably used in conjunction with amine-co-initiators.

A particularly preferred photoinitiator is 2-hydroxy2-methyl-1-phenyl-propan-1-one which product is marketed by E. Merck, Darmstadt, Germany under the trade name DAROCURE™ 1173.

Other very useful free radical producing photoinitiator compounds are bisimidazolyl compounds substituted in the 2-, 4- and 5-position with aromatic groups e.g. phenyl groups including substituted phenyl groups.

Examples of such compounds are 2,4,5-triphenylimidazolyl dimers consisting of two lophine radicals bound together by a single covalent bond and derivatives thereof described in GB-P 997,396 and 1,047,569. These photoinitiators are used advantageously in the presence of agents containing active hydrogen atoms, e.g. organic amines, mercaptans and triphenylmethane dyes as set forth e.g. in said GB-P specifications.

A preferred free-radical producing combination contains 2-mercaptobenzoxazole and said 2,4,5-triphenylimidazolyl dimer.

Still other particularly suitable photopolymerization initiators are the oxime esters described in published European patent application 57947.

The above mentioned photopolymerization initiators may be used alone or as a mixture of two or more and optionally in the presence of a photosensitizer for accelerating the effect of the photoinitiator. The absorption wavelength of the photoinitiation system may be shifted into the visible part of the spectrum (400–700 nm).

Inert binders can be added to the curable composition of the curable layer. This can be done for adjusting the transport properties, the sticking behaviour, the coating characteristics and the like.

The crosslinking of the curable layer is performed after imagewise transfer of reducing agent to the receiving element. This has the advantage that the transport of the reducing agent through the curable layer is not substantially hindered. Crosslinking of the curable layer decreases the permeability of the curable layer for organic and inorganic molecules, leading to a decrease in odour problems.

It can be advantageous to cure the curable layer partially before image-wise heating in order to decrease the stickiness of said curable layer if it forms the topmost layer, provided that after image-wise heating it can be further cured.

Chemical hardening can be performed on the heating device used for the overall heating, and can proceed even simultaneously.

Photochemical hardening is performed by means of a UV or electron beam source preferably prior to the overall heat treatment of the receiving element.

An adhesive subbing layer is usually provided between the support and the receiving layer, such as those mentioned in e.g. U.S. Pat. Nos. 4, 748,150, 4,954,241, 4,965,239 and 4,965,238 and European Patent Application no. 92 201 620.9.

The subbing layer can further comprise other polymers, particles, or low molecular weight additives. Addition of inorganic particles such as silica, colloidal silica, water soluble polymers such as gelatin, polymeric latices, polystyrene sulfonic acid and polystyrene sulfonic acid sodium salt, surfactants such as cationic, anionic, amphoteric and non-ionic surfactants, and polymeric dispersants is preferred.

Especially preferred additives are colloidal silica, the above mentioned surfactants, butadiene containing latices such as poly (butadiene-co-methylmethacrylate-co-itaconic acid), polystyrene sulfonic acid and polystyrene sulfonic acid sodium salt. The addition of silica to the subbing layer decreases sticking on the coating roll after coating of the subbing layer. The addition of polystyrene sulfonic acid or polystyrene sulfonic acid sodium salt to the subbing layer accelerates the recycling process.

The subbing layer of the present invention is applied directly to the support of the receiving element. The subbing layer can be applied by coextrusion or can be coated on the support. Coating from aqueous solution is preferred due to its simplicity and the possibility of adding other ingredients.

The receiving layer is usually hydrophobic in order to enhance the absorption of reducing agent into the receiving element. The polyester recycling procedure, however, uses a cleaning step wherein the film waste is immersed in an alkaline or acid soap solution in ater. It is an object of this cleaning process to remove all layers casted on the polymeric substrate.

In order to remove the hydrophobic receiving layer, it is highly preferred to cast an intermediate layer cf an hydrophilic polymer between the subbing layer and the dye-receiving layer. This intermediate layer accelerates the cleaning step in the recycling procedure. Typical examples of hydrophilic polymers which can be used in such intermediate layers are polyvinyl alcohol, polyacrylamide, hydroxyethylcellulose, gelatin, polystyrene sulfonic acid, polyethylene glycol, poly (meth) acrylic acid, poly (meth) acrylic acid, alkali metal salts of polyacrylic acid, crosslinked copolymers containing (meth)acrylic acid or alkali metal salts of (meth)acrylic acid, alkali metal salts of polystyrene sulfonic acid, dextran, carrageenan and the like. Anti-static coatings such as those described in EP 440,957 can be incorporated in the intermediate layer. This results both in a higher hydrophilicity and in better anti-static properties.

The intermediate layer may further comprise polymeric dispersions or latices, surfactants, inorganic particles such as silica and colloidal silica and the like. Addition of surfactants, colloidal silica and/or latices is preferred. Addition of silica to the intermediate layer decreases sticking to the coating roll after coating. Addition of latices to the intermediate layer improves the addition and improves the removing step in the recycling process in case of acrylic acid or methacrylic acid type latices.

The intermediate layer may also have a cushioning property, such as mentioned in U.S. Pat. No. 4,734,397.

A highly preferred intermediate layer is based on polystyrene sulphonic acid, hydroxyethylcelluiose and an anionic surfactant.

The support for the receiving element may be a transparant film of e.g. polyethylene terephthalate, a polyether sulfone, a polyimide, a cellulose ester, or a polyvinyl alcohol-co-acetal. The support may also be a reflective one such as baryta-coated paper, polyethylene-coated paper, or white polyester i.e. white-pigmented polyester as disclosed in e.g. EP-A 35197, EP-A 322771 and EP-A 289161. Blue-coloured polyethylene terephthalate film can also be used as a support.

Although the subbing layer is useful for application on polyethylene-coated paper, substrates based on polyester, transparent or reflective, are preferred. In this case, the subbing layer can be applied before, during or after the biaxial stretching procedure.

At the opposite side of the receiving element (opposite to the receiving layer), a backcoat can be provided, optionally in combination, with an appropriate subbing layer to improve the adhesion between the backcoat and the support.

Hydrophilic as well as hydrophobic backcoats can be used. Hydrophilic backcoats can be applied easily from water, while hydrophobic backcoats have the advantage that the backcoat performs well at all humidity levels.

Examples of hydrophilic backcoat layers are layers comprising polyvinyl alcohol, polyethylene glycol, polyacrylamide, hydroxyethylcellulose, dextran and gelatin. The use of gelatin is highly preferred.

These hydrophilic backcoat layers may further comprise dispersions or latices of hydrophobic polymers, inorganic particles, surfactant and the like. The addition of these particles can be used in order to obtain a specific surface gloss, such as mentioned in European patent application no. 91 203 008.7. Especially preferred particles are silica and polymethylmethacrylate beads of 0.5 to 10 μm. Antistatic treatment can also be provided to said backcoat layer.

Examples of hydrophobic backcoat layers are backcoat layers comprising addition polymers such as polymethylmethacrylate, polyvinylchloride and polycondensates such as polyesters, polycarbonates in combination with the above mentioned particles for the hydrophilic backcoat layers.

With hydrophobic backcoat layers, it can be useful to provide an intermediate hydrophilic layer between the subbing layer and the backcoat layer, such as those mentioned for use at the receiving side of the receiving element, in order to improve the removal of the backcoat layer in the recycling procedure.

The donor element for use in the printing process of the present invention comprises a donor layer comprising a binder and a thermotransferable reducing agent.

Examples of suitable reducing agents are aminohydroxycycloalkenone compounds, esters of amino reductones, N-hydroxyurea derivatives, hydrazones of aldehydes and ketones, phosphoramidophenols, phosphoramidoanilines, polyhydroxybenzenes, e.g. hydroquinone, t-butylhydroquinone, isopropylhydrooquinone, and (2,5-dihydroxyphenyl) methylsulfone, dihydroxybenzene derivatives such as pyrocatechol, and pyrogallol derivatives such as 4-phenylpyrocatechol, t-butylcatechol, pyrogallol, or pyrogallol derivatives such as pyrogallol ethers or esters, dihydroxybenzoic acid, dihydroxybenzoic acid esters such as dihydroxybenzoic acid, methyl ester, ethyl ester, propyl ester, butyl ester arid the like, gallic acid, gallic acid esters such as methyl gallate, ethyl gallate, propyl gallate and the like, gallic acid amides, sulfhydroxamic acids, sulfonamidoanilines, 2-tetrazolylthiohydroquinones, e.g. , 2-methyl-5-(1-phenyl-5-tetrazolylthio)hydroquinone, tetrahydroquinoxalines, e.g. 1,2,3, 4-tetrahydroquinoxaline, amidoximes, azines, hydroxamic acids, 5-pyrazolones, sulfonamidophenol reducing agents, 2-phenylindan-1,3-dione and the like, 1,4-dihydropyridines, such as 2, 6-dimethoxy-3,5-dicarbethoxy-1,4-dihydrepyridine, bisphenols, e.g. , bis (2-hydroxy-3-t-butyl-5-methylphenyl) methane, bis (6-hydroxy-m-toly)mesitol, 2,2-bis (4-hydroxy-3-methylphenyl) propane, 4,4-ethylidene-bis (2-t-butyl-6-methylphenol) and 2,2-bis (3,5-dimethyl-4-hydroxyphenyl) propane, ascorbic acid derivatives and 3-pyrazolidones.

Reducing agents having a coloured oxidation product or wherein the oxidation product is capable of forming colour can also be used. Examples are 4-methoxynaphthol and leucoazomethines such as mentioned in European Patent Application No. 94200613.

Reducing agents selected from the group of pyrocatechol, pyrocatechol derivatives, gallol and gallotderivatives and leucoazomethines are preferred. Especially preferred reducing agents are 4-phenylpyrocatechol and derivatives, gallic acid alkyl esters and dihydrobenzoic acid alkyl esters.

Two or more reducing agents can be used in the donor layer. It may be advantageous to use a thermotransferable dye in combination with said reducing agent. This is especially usefull when black images having a neutral grey tone are required, e.g. in medical applications. The principle of the use of thermotransferable dyes is explained in more detail in European Patent Application No. 94200796.

As a binder for the donor layer, hydrophilic or hydrophobic binders can be used, although the use of hydrcphobic binders is preferred.

Hydrophilic binders that can be used are polyvinylalcohol, gelatine, polyacrylamide and hydrophilic cellulosic binders such as hydroxyethyl cellulose, hydroxypropyl cellulose and the like.

The hydrophobic binders may be used as a dispersion in e.g. water or as a solution in an organic solvent.

Suitable binders for the donor layer are cellulose derivatives, such as ethyl cellulose, methyl cellulose, cellulose nitrate, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derivated from acrylats and acrylate derivatives, such as polymethyl metahcrylate and styrene-acrylate copolymers; polyester resins; polycarbonates; copoly (styrene-co-acrylonitrile); polysulfones; polyphenylene oxide; organosilicones, such as polysiloxanes; epoxy resins and natural resins, such as gum arabic. Preferably, the binder for the donor layer of the present invention comprises poly(styrene-co-acrylonitrile).

The binder for the donor layer preferably comprises a copolymer comprising styrene units and acrylonitrile units, preferentially at least 60% by weight of styrene units and at least 25% by weight of acrylonitrile units binder. The binder copolymer may, of course, comprise other comonomers than styrene units and acrylonitrile units. Suitable other comonomers are e.g. butadiene, butyl acrylate, and methyl methacrylate. The binder copolymer preferably has a glass transition temperature of at least 50° C.

It is, of course, possible to use a mixture of the copolymer comprising styrone units and at least 15% by weight of acrylonitrile units with another binder known in the art, but preferably the acrylonitrile copolymer is present in an amount of at least 50% by weight of the total amount of binder.

The donor layer generally has a thickness of about 0.2 to 5.0 μm, preferably 0.4 to 2.0 ,μm and the amount ratio of reducing agent to binder generally ranges from 9:1 to 1:10 weight, preferably from 3:1 to 1:5 by weight.

The donor layer may also contain other additives such as i.a. thermal solvents, stabilizers, curing agents, preservatives, dispersing agents, antistatic agents, defoaming agents, and viscosity-controlling agents.

The donor layer may also contain particles protruding from the surface of the donor element, such as described in European Patent Application No.94200788.

Highly preferred particles for use in connection with the present invention are polymethylsilylsesquioxane particles such as e.g. Tospearl™ 120, Tospearl™ 130 and Tospearl™ 145 (Toshiba Silicone). In case a laser is used to heat tke donor layer of the donor element, an infra-red absorbing substance is advantageously added to one of the layers of the donor element, preferably to the donor layer.

Any material can be used as the support for the donor element provided it is dimensionally stable and capable of withstanding the temperatures involved. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a support comprising polyethylene terephthalate. In general, suitable supports for use in combination with a thermal head can have a thickness of 2 to 30 μm, preferably a thickness of 4 to 10 μm is used. The thickness of the support for image-wise heating with a laser is less critical. Usually a thicker support of 30 to 300 ]μm is used. The support may also be coated with an adhesive of subbing layer, if desired.

Subbing layers comprising aromatic copolyesters, vinylidene chloride copolymers, organic titanate, zirconates and silanes, polyester urethanes and the like can be used.

The donor layer of the donor element can be coated on the support or printed thereon by a printing technique such as a gravure process.

A barrier layer comprising a hydrophilic polymer may also be employed between the support and the donor layer of the donor element to enhance the transfer of reducing agent by preventing wrong-way transfer of reducing agent backwards to the support. The barrier layer may contain any hydrophilic material that is useful for the intended purpose. In general, good results can be obtained with gelatin, polyacrylamide, polyisopropyl acrylamide, butyl methacrylate-grafted gelatin, ethyl methacrylate-grafted gelatin, ethyl acrylate-grafted gelatin, cellulose monoacetate, methylcellulose, polyvinyl alcohol, polyethyieneimine, polyacrylic acid, a mixture of polyvinyl alcohol and polyvinyl acetate, a mixture of polyvinyl alcohol and polyacrylic acid, or a mixture of cellulose monoacetate and polyacrytic acid.

Certain hydrcphilic polymers e.g. those described in EP 227,091 also have an adequate adhesion to the support and the layer, so that the need for a separate adhesive or subbing layer is avoided. These particular hydrophilic polymers used in a single layer in the donor element thus perform a dual function, hence are referred to as barrier/subbing layers. The back side of the donor element for image-wise heating with a laser is not critical. Typically a transparant coating is used, incorporating particles to enhance the transport properties.

Owing to the fact that the thin support softens when heated by a thermal head during the printing operation and then sticks to the thermal printing head, thereby causing malfunction of the printing apparatus and reduction in image quality, the back of the support (the side opposite to that carrrying the donor layer) is preferably provided with a heat-resistant layer to facilitate passage of the donor element past the thermal printing head. An adhesive layer may be provided between the support and the heat-resistant layer.

Any heat-resistant layers known in the field of thermal sublimation printing or wax printing can be used in the present invention.

The heat-resistant layer generally comprises a lubricant and a binder. In the conventional heat-resistant layers the binder is either a cured binder as described in e.g. EP 153,880, EP 194,106, EP 314,348, EP 329,117, JP 60/151,096, JP 60/229,787, JP 60/229,792 JP 60/229,795, JP 62/48,589, JP 62/212,192, JP 62/259,889, JP 01/5884, JP 01/56,587, and JP 92/128,899 or a polymeric thermoplast as described in e.g. EP 267,469, JP 58/187,396, JP 63/191,678, JP 63/191,679, JP 01/234,292, and JP 02/70,485.

During printing, a smooth transport of the donor ribbon and the receiving element is required in order to obtain a good density unifcrmity all over the print.

It is preferred to use different types of lubricants to allow continuous transport of the donor ribbon relative to the thermal head.

Well known lubricants are polysiloxanes such as those mentioned in EP 267,469, U.S. Pat. Nos. 4,738,950, 4,866,028, 4,753,920 and 4,782,041. Especially useful slipping agents are polysiloxane-polyether block or graft polymers.

Other lubricants for the heat-resistant slipping layer of the donor element are phosphoric acid derivatives such as those mentioned in EP 153,880 and EP 194,106, metal salts of long fatty acids (such as mentioned in EP 458,538, EP 458,522, EP314,348, JP 01/241,491 and JN 01/222,993), wax compounds such as polyolefin waxes such as e.g. polyethylene or polypropylene wax, carnauba wax, bees wax, glycerine monostearate, amid wax such as ethylene bisstearamide and the like.

A heat-resistant layer such as mentioned in European Patent Application no. 93 202 050.6 is especially preferred.

Inorganic particles such as salts derived from silica such as e.g. talc, clay, china clay, mica, chlorite, silica, or carbonates such as calcium carbonate, magnesium carbonate or calcium magnesium carboante (dolomite) can be further added to the heat-resistant layer.

It is highly preferred to add mixtures of particles to the heat resistant layer having a Mohs hardness below 2.7 and particles having a Mohs hardness above, 2.7 such as mentioned in EP-A-3201642.1.

A mixture of talc and dolomite particles is highly preferred.

A particular heat-resistant layer for the present invention comprises as a binder a polycarbonate derived from a bis-(hydroxyphenyl)-cycloalkane, corresponding to the following general formula:

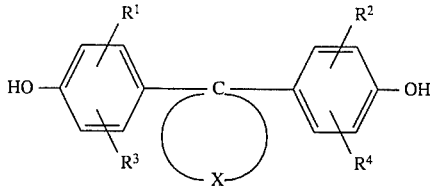

wherein:

$R^1$, $R^2$, $R^3$, and $R^4$ each independently represents hydrogen, halogen, a $C_1$–$C_8$ alkyl group, a substituted $C_1$–$C_8$ atkyl group, a $C_5$–$C_6$ cycloalkyl group, a substituted $C_5$–$C_6$ cycloalkyl group, a $C_6$–$C_{10}$ aryl group, a substituted $C_6$–$C_{10}$ aryl group, a $C_7$–$C_{12}$ aralky group, or a substituted $C_7$–$C_{12}$ aralkyl group; and X represents the atoms necessary to complete a 5- to 8-membered alicyclic ring, optionally substituted with a $C_1$–$C_6$ alkyl group, a 5- or 6-membered cycloalkyl group or a fused-on 5- or 6-membered cycloalkyl group, as lubricants polyether modified polysiloxane block copolymer and zinc stearate and as particles talc particles with a mean size of 4.5 μm.

Lubricants and binder can be coated in a single layer, or can be casted in a separate layer. It is highly preferred to cast the salt of a fatty acid in the heat resistant layer (e.g. as a dispersion) and the polysiloxane based lubricant in a separate topcoat. This separate topcoat is preferably casted from a non-solvent for the heat-resistant layer.

The heat-resistant layer of the donor element may be coated on the support or printed thereon by a printing technique such as a gravure printing.

The heat-resistant layer thus formed has a thickness of about 0.1 to 3 μm, preferably 0.3 to 1.5 μm.

Preferably a subbing layer is provided between the support and the heat-resistant layer to promote the adhesion between the support and the heat-resistant layer. As subbing layer any of the subbing layers known in the art for dye-donor elements can be used. Suitable blinders that can be used for the subbing layer can be chosen from the classes of polyester resins, polyurethane resins, polyester urethane resins, modified dextrans, modified cellulose, and copolymers comprising recurring units such as i.a. vinyl chloride, vinylidene chloride, vinyl acetate, acrylonitrile, methacrylate, acrylate, butadiene, and styrene (e.g. poly (vinylidene chloride-co-acrylonitrile). Suitable subbing layers have been described in e.g. EP 138,483, EP 227,090, European Patent Application No. 92200907.1, U.S. Pat. Nos. 4,567,113, 4,572,860, 4,717,711, 4,559,273, 4,695,288, 4,727,057, 4,737,486, 4,965,239, 4,753,921, 4,895,830, 4,929,592, 4,748,150, 4,965,238, and 4,965,241.

The printing method of the present invention preferably uses a thermal head to selectively heat specific portions of the donor element in contact with a receiving element. The thermal head can be a thick or thin film thermal head although the use of a thin film thermal head is preferred, since this offers more opportunities to obtain appropriate gradation. The pressure applied to the thermal head is preferably between 120 and 400 g/cm heater line. A spatial resolution of 150 dpi or higher is preferred. The average printing power is calculated as the total amount of energy applied during one line time divided by the line time and by the surface area of the heat-generating elements.

Although a higher average printing power results in higher optical densities of the final image, is is preferred to use an average printing power below 10 W/mm$^2$. At higher printing energies, deformation of the receiving layer and/or receiving sheet occurs.

The time needed for printing one single line with the thermal head, also called the line time, is preferably below 45 ms. Longer line times result in longer printing times and more deformation of the receiving sheet and/or receiving layer.

In order to increase the density of the final image after printing line-by-line with a thermal head, an overall heat treatment of the receiving element is performed. This heat treatment can be e.g. done with an infrared source, a heated air stream or a hot plate but is preferably done by means of a heated roller.

It is believed that during the overall heat treatment, the transferred reducing agent can further react with the reducible silver source.

By selecting the appropriate diameter and speed of the heated roller, the heat treatment time for the overall heating can be adjusted. Moreover, the heated rollers can be used to uncurl the receiving sheet after printing.

The following examples illustrate the invention in more detail without, however, limiting the scope thereof.

EXAMPLES

Preparation of the Donor Element

Both sides of a 5.7 μm thick polyethylene terephthalate support were coated with a subbing layer of a copolyester comprising ethylene glycol, adipic acid, neopentyl glycol, terephthalic acid, isophthatic acid, and glycerol.

The resulting subbing layer was covered with a solution in methyl ethyl ketone of 13% of a polycarbonate having the following structural formula (X):

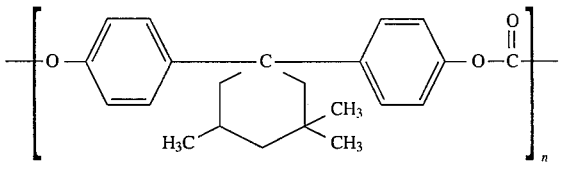

wherein n represents the number of units to obtain a polycarbonate having a relative viscosity of 1.30 as measured in a 0.5% solution in dichloromethane, 0.5% of talc (Nippon Talc™ P3, Interorgana) and 0.5% of zinc stearate.

Finally, a top layer of polyether-modified polydimethylsilocane (Tegoglide™ 410, Goldschmidt) was coated from a solution in isopropanol on the resulting heat-resistant polycarbonate layer.

The other side of the reductor donor element was provided with a reductor layer.

A mixture of 10 weight % binder (Luran™ 388S, BASF), 8 weight % 4-phenylpyrocatechol, 5 weight % of propylgallate and 2 % of a cyan dye having a structural formula XI:

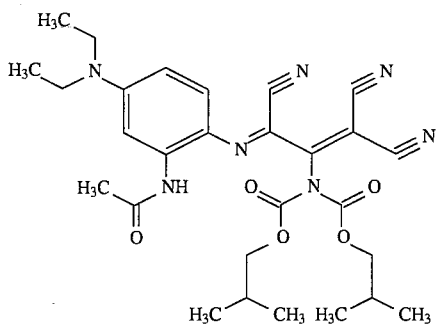

(XI)

and 0.5 weight % Tospearl™ 145 was applied at a wet thickness of 10 μm by means of a wire bar. The resulting layer was dried by evaporation of the solvent.

Preparation of the Receiving Elements

A subbed polyethylene terephthalate support having a thickness of 175 μm was coated in order to obtain the following receiving layer:

silver behenate 4.5 g/m$^2$ compound I mentioned above 0.34 g/m$^2$ polyvinylbutyral (Butvar™ B79, Monsanto) 4 5 g/m$^2$ The curable layers were coated from butanone at a wet thickness of 50 μm and dried by evaporation of the solvent. The ingredients are listed in table I. The percentages are weight percentages in the coating solution.

Printing of the Combination of Donor and Receiving Elements

Printing was performed by contacting the donor layer of the donor element with the receiving side of the receiving element, followed by heating by means of a thermal head. The thermal head was a thin film thermal head heated at an average printing power of 5 Watt/mm$^2$ and a line time of 18 ms with a resolution of 300 dpi. The pressure applied between the thermal head and the rotating drum carrying the receiving and donor element was 160 g/cm heater line. After printing, the receiving element was separated from the donor element.

The printed image was a 16-step grey scale between data level 0 and 255 (8 bit). The data levels of the different steps were choosen equidistant with respect to the input data level in order to obtain the native sensitometry.

Curing of the Curable Layer

The curable layers were cured by exposing the receiving element to a UV-source.

Overall Heat Treatment

All receiving elements were reheated on a hot plate of 118° C. for 10 seconds. The odour was evaluated qualitatively. The following criteria were used:

B: Bad: a clearly discernable odour is observed.

G: Good: no substantial odour observed.

Measurement of the optical density of the prints

The optical maximal densities of the prints were measured after a visual filter in a Macbeth TR924 densitometer in the grey scale part corresponding to data level 255.

The results are listed in table I.

TABLE I

| Curable Layer Ingredients | | | | | |
|---|---|---|---|---|---|
| | | Additives | | | |
| Sample | Binder | A | B | C | D |
| 1 | 1.82 | 0.18 | 0.18 | 1.82 | — |
| 2 | 1.82 | 0.18 | 0.18 | — | 1.82 |

TABLE I-continued

| | Curing Conditions | | | | | |
|---|---|---|---|---|---|---|
| | None | | Before image-wise printing | | After image-wise printing | |
| Sample | Density | Odour | Density | Odour | Density | Odour |
| 1 | 2.71 | B | 2.41 | G | 2.60 | G |
| 2 | 2.65 | B | 2.29 | G | 2.42 | G |

Binder: Jaylink™ 105 E (Bomar Specialities)

Additives : A : Darocure™ 1173 (2-hydroxy-2-methyl-1-phenyl-propane-1-one (Ciba-Geigy)

B: Tegoglide™ 410 (Goldschmidt)

C: Ebecryl™ 624 (aromatic epoxy acrylate dissolved in 1,6-hexanediol diacrylate in a 90/10 ratio (UCB)

D : Dipentaerythritol monchydroxypentaacrylate (SR-399™ Cray Valley)

It is clear from table I that the printing process of the present invention combines high optical densities without odour problems. Curing before image-wise heating decreases the optical density of the final image (after overall heating).

What is claimed is:

1. A thermal imaging process comprising the steps of:

a) bringing a donor layer of a donor element into face to face relationship with a curable layer of a receiving element to obtain an assemblage, said receiving element further having a receiving layer below said curable layer, b) image-wise heating the assemblage, thereby causing image-wise transfer of an amount of a thermotransferable reducing agent to said receiving element, the amount of transferred reducing agent being proportional to the amount of heat supplied, c) separating said donor element from said receiving element, d) curing said curable layer, and e) overall heating said receiving element, wherein (i) said donor element comprises on a support, (a) a donor layer comprising a binder and a thermotransferable reducing agent which is capable of reducing a silver source to metallic silver upon heating, and (ii) said receiving element comprises said receiving layer on a support, said receiving layer comprising a silver source which is capable of being reduced by means of heat in the presence of the reducing agent.

2. Thermal imaging process according to claim 1 wherein said curing is performed by means of UV-light.

3. Thermal imaging process according to claim 1 wherein said binder of the receiving layer is polyvinyl butyral.

4. Thermal imaging process according to claim 1 wherein the curable layer comprises a hydrophobic binder.

5. Thermal imaging process according to claim 1, wherein said receiving layer further comprises a weak reducing agent.

6. Thermal imaging process according to claim 1, wherein said image-wise heating is done by means of a laser or a thermal head.

7. Thermal imaging process according to claim 1 wherein said curable layer comprises a release agent.

* * * * *

UNITED STATES PATENT AND TRADEMARK OFFICE

CERTIFICATE OF CORRECTION

PATENT NO. : 5,558,972

DATED : September 24, 1996

INVENTOR(S) : Van Damme et al.

It is certified that error appears in the above-indentified patent and that said Letters Patent is hereby corrected as shown below:

Column 2, line 60, "stoatic acid" should read --stearic acid--;

Column 3, line 1, "benziiic" should read --benzilic--;

Column 3, line 44, "phthatazinone" should read --phthalazinone--;

Column 5, line 15, "oossible" should read --possible--;

Column 5, line 66, "trimethylolprepane" should read --trimethylolpropane--;

Column 6, line 21, "benzophenene" should read --benzophenone--;

Column 6, line 25, "2,2-diethoxyacetophenene" should read --2,2-diethoxyacetophenone--;

Column 6, bridging lines 25-26, "2,2-dimethoxy-2phenytacetophenone" should read --2,2-dimethoxy-2-phenylacetophenone--;

Column 6, line 26, "thioxanthene" should read --thioxanthone--;

Column 8, line 21, "35197" should read --351971--;

UNITED STATES PATENT AND TRADEMARK OFFICE

CERTIFICATE OF CORRECTION

PATENT NO. : 5,558,972

DATED : September 24, 1996

INVENTOR(S) : Van Damme et al.

It is certified that error appears in the above-indentified patent and that said Letters Patent is hereby corrected as shown below:

Column 9, line 3, "isopropylhydrooquinone" should read --isopropylhydroquinone--;

Column 9, line 18, "dihydrepyridine" should read --dihydropyridine--;

Column 9, line 30, "gallotderivatives" should read --gallol derivatives--;

Column 10, line 11, "styrone" should read --styrene--;

Column 10, line 66, "polyethyieneimine" should read --polyethyleneimine--;

Column 11, line 2, "polyacrytic" should read --polyacrylic--;

Column 11, line 62, "EP-A-3201642.1" should read --EP-A-93201642.1--;

Column 12, line 17, "aralky" should read --aralkyl--.

Signed and Sealed this

Twenty-fifth Day of March, 1997

*Attest:*

Bruce Lehman

BRUCE LEHMAN

*Attesting Officer*

*Commissioner of Patents and Trademarks*